United States Patent [19]

Kopp

[11] 4,181,052

[45] Jan. 1, 1980

[54] APPARATUS FOR STACKING FILLED BAGS

[75] Inventor: Georg Kopp, Neuhausen am Rheinfall, Switzerland

[73] Assignee: SIG Schweizerische Industrie-Gesellschaft, Neuhausen am Rheinfall, Switzerland

[21] Appl. No.: 885,897

[22] Filed: Mar. 13, 1978

[30] Foreign Application Priority Data

Mar. 11, 1977 [CH] Switzerland ..... 3126/77

[51] Int. Cl.[2] ..... B65H 31/32; B65H 31/10

[52] U.S. Cl. ..... 83/79; 270/39; 270/79

[58] Field of Search ..... 83/79; 270/79, 39

[56] References Cited

U.S. PATENT DOCUMENTS

| | | | |
|---|---|---|---|
| 3,195,883 | 7/1965 | Southwell et al. | 270/79 |
| 3,495,819 | 2/1970 | Davidson | 270/79 |
| 3,735,554 | 5/1973 | Maggio | 270/79 |
| 3,913,904 | 10/1975 | Occhetti | 270/39 |
| 4,045,012 | 8/1977 | Jakob | 270/79 |
| 4,053,151 | 10/1977 | Frezza | 270/79 |

*Primary Examiner*—J. M. Meister

*Attorney, Agent, or Firm*—Spencer & Kaye

[57] ABSTRACT

An apparatus for stacking filled flat bags advanced thereto in at least one coherent row forming a bag web of indeterminate length, comprises an advancing arrangement for feeding the bag web vertically downwardly; an orienting arrangement for imparting a back-and-forth oscillating motion on the downwardly advancing bag web; a collecting arrangement situated below the orienting arrangement in the path of the bag web for receiving the bag web in zigzag-folded layers; and a synchronizing arrangement for coordinating the operational speed of the advancing arrangement with that of the orienting arrangement for determining the length of the zigzag-folded layers deposited on the collecting arrangement.

9 Claims, 6 Drawing Figures

2
12
11
1
4
10
9
13
II
1
4
20
A1
21
19
A
24
22
17a
15
17b
21
25
16b
17c
a
14
16a
23
2
12
10

9
21
25
19
a
16b
14
15
17a
17b
16a
2
12
10

9
19
A1
21
25
17a
17b
15
17c
16b
14
16a

APPARATUS FOR STACKING FILLED BAGS

BACKGROUND OF THE INVENTION

This invention relates to an apparatus for stacking filled flat bags which form a coherent web having one or several bag rows.

In apparatuses of the above-outlined type, first the individual bags are severed from one another by a cutter and then the bags are stacked on one another. The mechanisms to perform these operations are quite complex and substantially limit the output rate. Further, the stacks obtained by these apparatuses are unstable, so that they have to be placed in relatively strong cardboard boxes or stacked directly therein; these operations further contribute to a diminishing output rate.

SUMMARY OF THE INVENTION

It is an object of the invention to provide an improved apparatus of the above-outlined type from which the discussed disadvantages of prior art arrangements are eliminated.

This object and others to become apparent as the specification progresses, are accomplished by the invention, according to which, briefly stated, the apparatus for stacking filled flat bags advanced thereto in at least one coherent row forming a bag web of indeterminate length, comprises an advancing arrangement for feeding the bag web vertically downwardly; an orienting arrangement for imparting a back-and-forth oscillating motion on the downwardly advancing bag web; a collecting arrangement situated below the orienting arrangement in the path of the bag web for receiving the bag web in zigzag-folded layers; and a synchronizing arrangement for coordinating the operational speed of the advancing arrangement with that of the orienting arrangement for determining the length of the zigzag-folded layers deposited on the collecting arrangement.

DESCRIPTION OF THE PREFERRED EMBODIMENT

Figures 1, 3, 4:
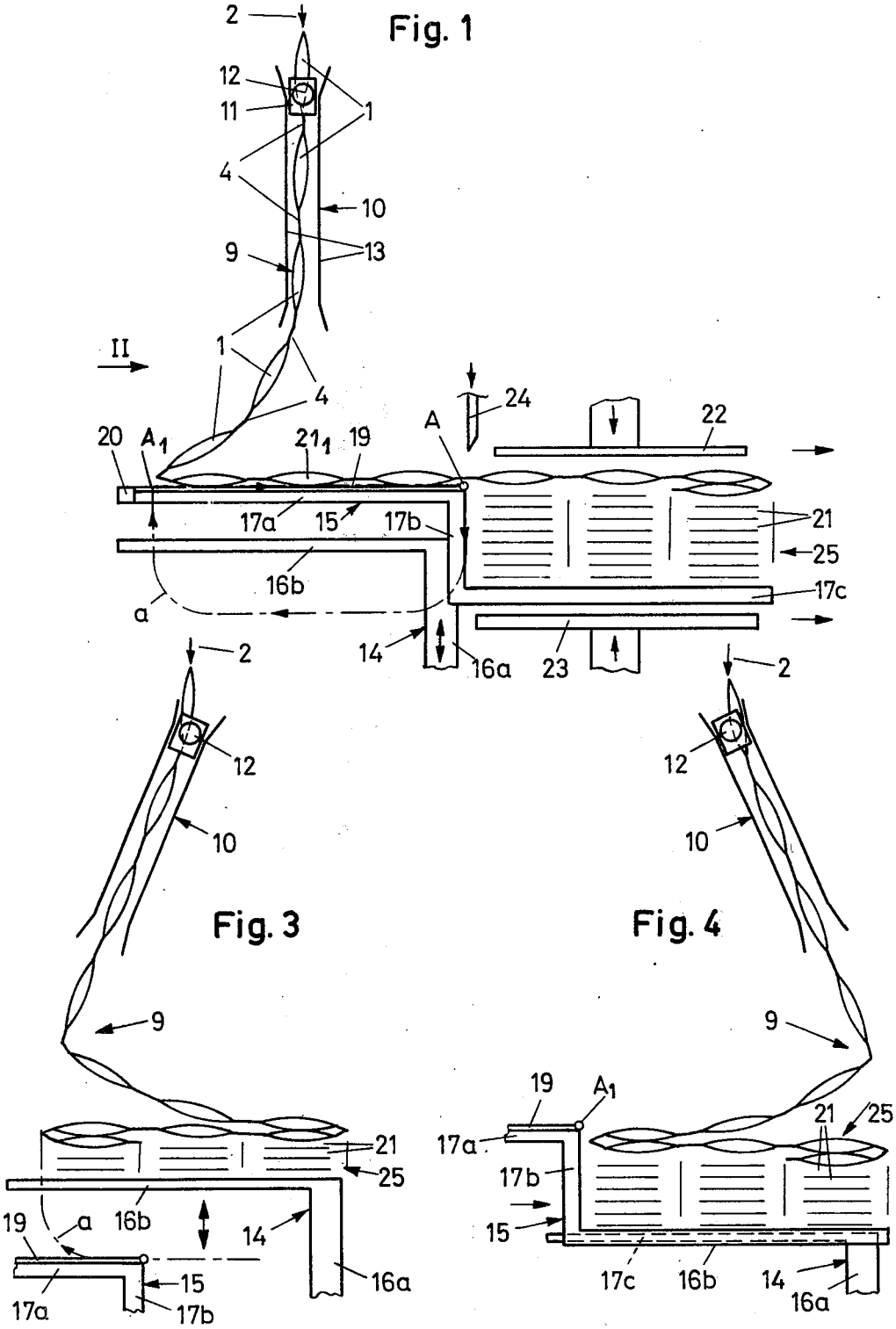
FIG. 1 is a schematic front elevational view of one part of a preferred embodiment of the invention.
FIGS. 3 and 4 are schematic front elevational views of some of the components illustrated in FIG. 1, shown in different operational phases.
Figure 2:
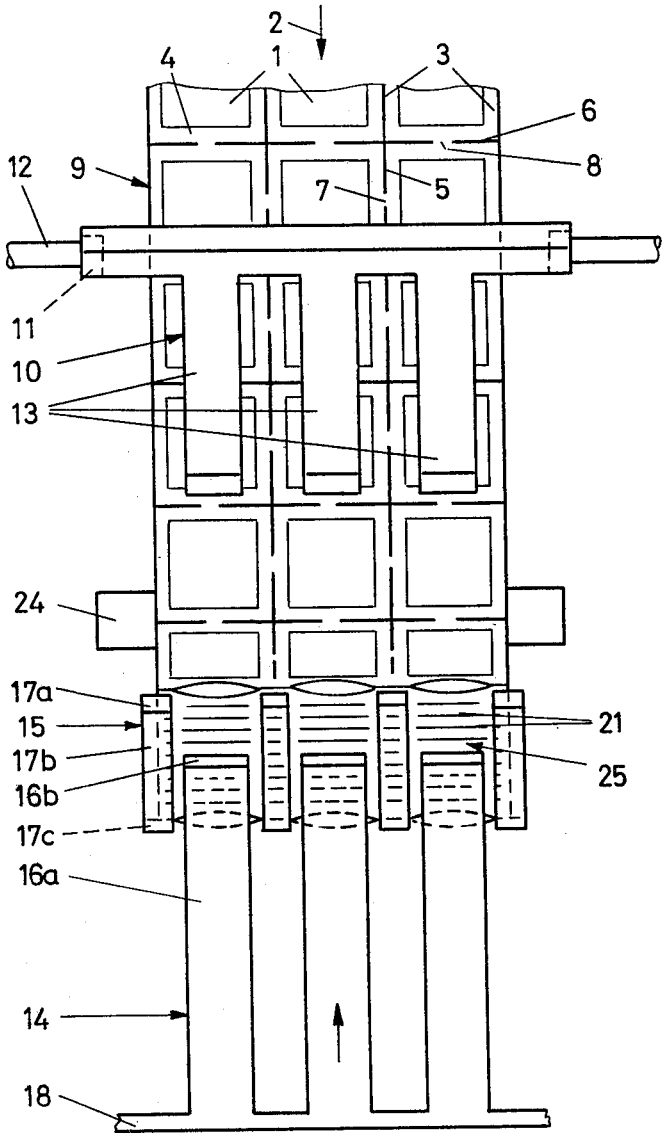
FIG. 2 is a schematic side elevational view taken in the direction of the arrow II of FIG. 1.

Turning now to FIGS. 1 and 2, flat bags 1, for example bags filled with tea, are advanced in the direction of the arrow 2 to the stacking apparatus shown. The bags are arranged in three parallel rows (each extending in the direction of bag advance) and are interconnected by longitudinal seams 3 and transverse seams 4. The seams 3 and 4 are, in their mid portion, provided with interrupted cuts 5 and 6, respectively, so that the bags 1 are connected to one another through the non-slotted locations 7 and 8 of the seams 3 and 4 with one another and form a "bag web" 9. Such bag webs and their manufacture are conventional. For advancing the bag web 9 downwardly, there is provided at least one pair of oppositely rotating rollers 2*a* and 2*b* having horizontal axes which, upstream of the stacking apparatus, pinch the bag web 9 in the zone of the longitudinal seams 3.

The bag web 9 runs between two parallel guide walls 10 which, at their upstream part (as viewed in the direction of bag web advance) are secured to two holders 11 which, in turn, are attached to two axially aligned, common pivotal shafts 12. The guide walls 10 have a fork-like configuration; each wall has three downwardly oriented tines 13 each being in registry with a separate one of the three bag rows. The fork-like configuration of the pivotal guide walls 10 reduces their inertia which is of significance, since during operation the guide walls 10 are oscillated back and forth as many as 200 times per minute (through an angle which preferably does not exceed 60°).

Underneath the pivotal guide walls 10 there are arranged two grate-shaped 14 and 15. The slide 14 has a plurality of parallel-spaced, L-shaped grate bars, each having a vertical leg 16*a* and a horizontal leg 16*b*. The grate bars are, at an end of the vertical legs 16*a*, connected to one another by a transverse actuator rod 18. The slide 15 has a plurality of z-shaped grate bars, each having two spaced horizontal legs 17*a*, 17*c* connected to one another by a vertical leg 17*b*. The legs 17*a* are at their upper side provided with a friction coating 19. The friction coating (or friction insert) 19 may be a self-adhesive tape of the commercially available type, such as "3M SAFETY WALK, TYPE CONFORMABLE" (made by the Minnesota Mining & Manufacturing Co.) which has a frictional coefficient $\mu$ of at least 0.2 as compared to the sheet material from which the bag web 9 is conventionally made. The grate bars are, at the outer end of the legs 17*a*, connected to one another by a transverse actuator rod 20. The L-shaped bars of the slide 14 and the z-shaped bars of the slide 15 are arranged in a staggered relationship to permit interengagement of the two slides during operation.

The slide 14 which is movable vertically up and down is a "collecting slide" since, as shown in the operational phase of FIG. 3, layers 21 (each having a length of three bags) accumulate on the horizontal legs 16*b*. The slide 15 executes vertically a translational motion which corresponds to a closed, approximately rectangular curve a which in FIG. 1 is illustrated for the motion of the corner point A. The purpose of the slide 15 is to advance the bag layers 21 accumulated on the collecting slide 14 into the operational zone of two vertically oppositely movable conveying shoes 22 and 23. The slide 15 is, for this reason, designated as a "feeding slide". A knife 24 serves for severing a bag stack 25 situated in the operational range of the conveying shoes 22 and 23 (and still resting on the feeding slide 15) from the remainder of the bags 1. While the conveying shoe 22 may be formed of a continuous plate member, the conveying shoe 23 has a grate-like structure so that it can interengage with the horizontal legs 17*c* of the feeding slide 15.

In the description which follows, the operation of the above-described apparatus will be set forth.

In the operational phase illustrated in FIG. 3, the collecting slide 14 moves slowly downwardly and the feeding slide 15 moves towards the left. The pivotal guide 10, 11 and 12 continuously oscillates back and forth. The advancing speed of the bag web 9 in the direction of the arrow 2 and the oscillating motion of the pivotal guide 10–12 are coordinated in such a manner that during each half-period, the bag web 9 is advanced to a distance corresponding to the length of a predetermined number (for example, three) bags 1. As a result, the bag web 9 is deposited in a zigzag fashion onto the collecting side 14 and each zigzag layer in each bag row has three bags 1 that corresponds to a total of nine bags 1, since, according to FIG. 2, the bag web 9 has three bag rows. It will be understood that in practice usually more than three longitudinally extending, juxtapostioned bag rows are used to form the bag web. When the collecting slide 14 reaches its lowermost position as shown in FIG. 4, the corner point A of the feeding slide 15 attains its position $A_1$ at which time the lower horizontal leg 17*c* of the feeding slide 15 has lifted the bag stack off the horizontal legs 16*b* of the collecting side 14. During the successive horizontal motion of the feeding slide 15 towards the right along the upper horizontal part of the curve a, it carries with it the bag stack towards the right into the position illustrated in FIG. 1. Since the pivotal guide 10–12 continues to oscillate without interruption, new bag layers $\mathbf{21}_1$ are deposited in a zigzag manner onto the upper horizontal legs 17*a* of the feeding slide 15 which thus, in this position serve as an auxiliary collecting slide. Subsequently, the knife 24 is moved downwardly to sever the small bridges (connecting portions) 8 between the slot 6. The frictional coating 19 prevents the layer $\mathbf{21}_1$ from sliding on the legs 17*a* so that the knife 24 encounters a sufficient resistance for enabling it to perform its cutting function. It is to be noted that the severing device need not necessarily be a knife; an obtuse severing mechanism may suffice to rupture the bridges 8. It is further noted that it is feasible to dispense with the frictional insert 19 and to provide instead an immobilizing member which, shortly prior to the severing motion of the knife 24, is lowered onto the layer $\mathbf{21}_1$ for holding the latter firmly during the cutting operation.

The severed stack 25 is compressed by the conveying shoes 22 and 23 and is moved thereby towards the right in order to feed it to a packing machine which may, for example, insert the entire stack 25 into a lightweight paper box. It is, however, feasible to subdivide the stack 25 into three partial stacks which are then individually packed. As a rule, however, a subdivision of the stack is effected only in case the bag web is formed of a great number of longitudinally extending parallel rows. The feeding slide 15 remains in its discharging position according to FIG. 1 only until the collecting slide 14 has returned into its uppermost position in which its horizontal legs 16*b* lift the zigzag layers $\mathbf{21}_1$ (deposited on the horizontal legs 17*a* of the feeding slide 15) off the legs 17*a*. The upward motion of the collecting slide 14 is rapid. Subsequently, the feeding slide 15 moves downwardly and returns into its position shown in FIG. 3; thus the layers 21 accumulate again on the legs 16*b* of the collecting slide 14. Since the collecting slide 14 moves substantially faster upwardly then downwardly, only a few layers $\mathbf{21}_1$ are deposited onto the horizontal legs 17*a* of the feeding slide 15.

The apparatus designed according to the invention can operate at a very high output rate, since no delays are encountered in severing the successive bags from the stacks and further, the deposition of the layers 21 or $\mathbf{21}_1$ occurs in an uninterrupted manner. Also, the stacks 25 formed of zigzag-connected layers are substantially more stable than stacks prepared by prior art apparatuses. Consequently, the package groups may be packed in a less expensive wrapping material. Further, cutting devices of the type required in prior art arrangements are not needed and thus their inherent noise is also eliminated.

In accordance with a further variant, the collecting slide and the feeding slide may be structured and arranged symmetrically. In such an assembly, the feeding slide lifts the zigzag stack accumulated on the collecting slide alternately from the right and the left by virtue of the lowering of the collecting slide and conveys it respectively to the left or to the right into the operational zone of the one or the other of two conveying shoe pairs.

Figure 5:
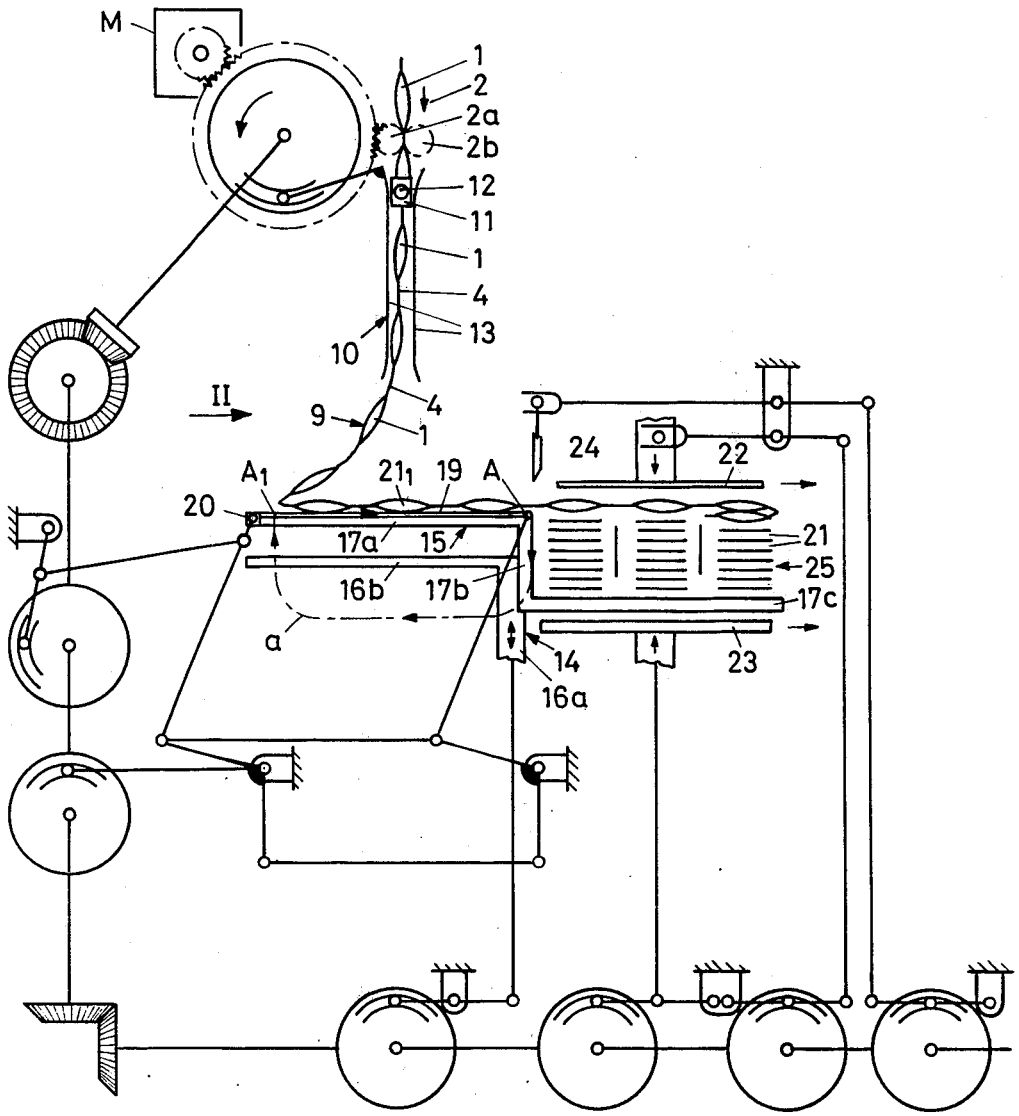
FIG. 5 is a schematic front elevational view similar to FIG. 1 showing the elements for synchronous drive.

The schematic view of FIG. 5 shows by way of example the interconnection between rollers 2*a* and 2*b*, guide walls 10, pivotal shafts 12, tines 13, slides 14 and 15, vertical legs 16*a* and horizontal 16*b* legs, conveying shoes 22, 23 and knife 24 for a synchronous drive by a single driving motor M.

Figure 6:
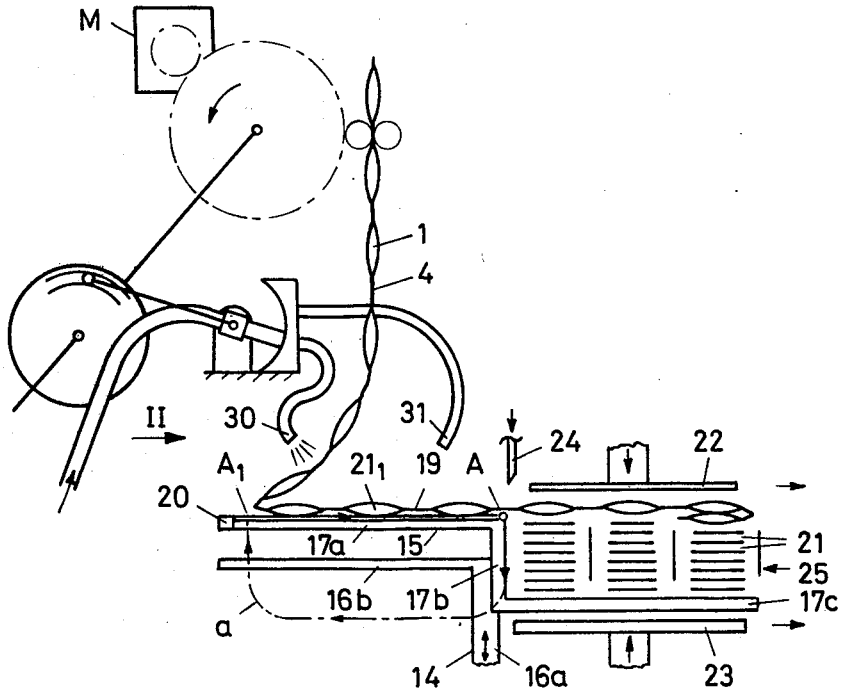
FIG. 6 is a schematic front elevational view of a further embodiment of the invention.

Turning now to FIG. 6, as an alternative to the pivotal guide 10–12 it is feasible to arrange nozzles 30, 31 on both sides of the advancing bag web 9. The nozzles emit compressed air in an alternating manner in order to cause the advancing bag web 9 to perform its required oscillating motion.

It will be understood that the above description of the present invention is susceptible to various modifications, changes and adaptations and the same are intended to be comprehended within the meaning and range of equivalents of the appended claims.

What is claimed is:

1. An apparatus for stacking filled flat bags advanced thereto in at least one coherent row forming a bag web of indeterminate length, comprising (a) advancing means for continuously feeding the bag web vertically downwardly;

(b) orienting means for imparting on the downwardly advancing bag web a continuous back-and-forth oscillating motion;

(c) a collecting means situated below said orienting means in the path of the bag web for receiving the bag web in a stack formed of zigzag-folded layers;

(d) synchronizing means for coordinating the operational speed of said advancing means with that of said orienting means for determining the length of the zigzag-folded layers of the stack deposited on said collecting means;

(e) first drive means for moving said collecting slide periodically upwardly and downwardly;

(f) a conveying means arranged adjacent the vertical traveling path of said collecting slide;

(g) a feeding slide arranged for displacement between and into effective zones of said collecting slide and said conveying means;

(h) second drive means for periodically moving said feeding slide to transfer from said collecting slide to said conveying means the stack accumulated on said collecting slide during the downward motion thereof; and (i) cutting means situated between said traveling path of said collecting slide and said conveying means for severing the layers of the stack on said conveying means from the bag web subsequent to the transfer of the stack from said collecting slide to said conveying means by said feeding slide.

2. An apparatus as defined in claim 1, wherein said orienting means comprises a guide member engaging the bag web on both sides and drive means connected to said guide member for imparting an oscillating motion thereto.

3. An apparatus as defined in claim 2, further comprising means for pivotally supporting said guide member.

4. An apparatus as defined in claim 2, wherein said guide member is formed of guide walls.

5. An apparatus as defined in claim 4, wherein each said guide wall is formed of parallel-extending fork tines.

6. An apparatus as defined in claim 1, wherein said feeding slide comprises a part constituting an auxiliary collecting slide receiving zigzag-folded layers of the bag web during operational phases when said auxiliary collecting slide is closer to said orienting means than said collecting slide.

7. An apparatus as defined in claim 6, wherein said collecting slide is formed of a first grate comprising a plurality of parallel-spaced first horizontal bars receiving the stack of zigzag-folded layers; further wherein said feeding slide is formed of a second, generally z-shaped grate comprising a plurality of parallel-spaced second horizontal bars transferring the stack from said first grate to said conveying means, a plurality of parallel-spaced third horizontal bars constituting said auxiliary collecting slide and a plurality of parallel-spaced vertical bars connecting said second horizontal bars to said third horizontal bars; the bars of said first grate being staggered with respect to the bars of said second grate for providing an interengaging relationship between the grates and an unobstructed passage of one grate through the traveling path of the other grate; further wherein said second drive means includes means for moving said feeding slide in a vertical plane along a generally rectangular closed path having two parallel vertical and two parallel horizontal path portions to move said second horizontal bars in consecutive cycles horizontally from the zone of said conveying means into the traveling path of said collecting slide, vertically upwardly in said traveling path, horizontally from said traveling path into the zone of said conveying means and vertically downwardly in the zone of said conveying means.

8. An apparatus as defined in claim 7, wherein said third horizontal bars of said feeding slide carry a friction layer on their upper side.

9. An apparatus as defined in claim 1, wherein said orienting means comprises nozzles disposed on either side of the traveling path of the bag web and oriented theretowards, and means causing said nozzles to alternatingly emit fluid under pressure to impart said oscillating motion on the bag web.

* * * * *